US006116686A

United States Patent [19]

Luo

[11] Patent Number: 6,116,686

[45] Date of Patent: Sep. 12, 2000

[54] ARMCHAIR

[76] Inventor: Wun-Thong Luo, 5F, No. 2, Alley 27, Lane 92, Yumin Rd., Tucheng, Taipei Hsien, Taiwan

[21] Appl. No.: 09/353,538

[22] Filed: Jul. 14, 1999

[51] Int. Cl.[7] ..... A47C 3/00

[52] U.S. Cl. ..... 297/286; 297/288; 297/295; 297/301.2; 297/301.7; 297/303.2

[58] Field of Search ..... 297/286, 287, 297/288, 295, 301.2, 301.6, 301.7, 303.2

[56] References Cited

U.S. PATENT DOCUMENTS

| | | | |
|---|---|---|---|
| 422,225 | 2/1890 | Kaufmann | 297/286 |
| 1,189,995 | 7/1916 | Olson | 297/286 |
| 5,308,142 | 5/1994 | Forslund, III et al. | 297/288 X |

FOREIGN PATENT DOCUMENTS

| | | | |
|---|---|---|---|
| 1029263 | 12/1950 | France | 297/286 |
| 524276 | 4/1955 | Italy | 297/286 |
| 2152808 | 8/1985 | United Kingdom | 297/303.2 |

*Primary Examiner*—Laurie K. Cranmer
*Attorney, Agent, or Firm*—Pro-Techtor International Services

[57] ABSTRACT

An armchair is disclosed. The armchair has a seatback, a pair of armrests securely mounted on both sides of the seatback, a spring-like base securely and respectively engaged with the pair of armrests and a seat a side of which engages with a bottom side of the seatback and provided between the armrests. A pneumatic cylinder is provided between the seat and a joint of the seatback and one of the armrests, such that the inclination difficulty of the seatback with respect to the seat is adjusted via the adjustment of the pneumatic cylinder.

1 Claim, 3 Drawing Sheets

ARMCHAIR

BACKGROUND OF THE INVENTION

1. Field of the Invention

The present invention relates to an armchair, and more particularly to an armchair having a pneumatic cylinder mounted thereon so as to provide suitable resistance to a user and a spring-like base integrally formed on the bottom of the chair such that the user is able to have suitable recovery force when seated thereon.

2. Description of Related Art

Chairs have been developed for centuries for users to sit thereon. In order to provide comfort for the users, various armchairs having all sorts of accessories are thus introduced to the market. However, all these armchairs are either heavy or have complex structure, which leads that the transportation and the assembly thereof are difficult and labor intensive.

To overcome the aforementioned problem, the present invention aims to provide an improved leisure having simple structure yet providing comfort to the user seated thereon.

The present invention provide an improved armchair to mitigate and/or obviate the defect of complex structure and heavy weight.

SUMMARY OF THE INVENTION

The main object of the present invention is to provide a armchair having a pneumatic cylinder provided thereon and a spring-like base integrally formed on the bottom thereof, such that the inclination of the seatback of the chair is able to be adjusted and the user thereon is also able to have comfort by the recovery force via the base.

The detailed features of the present invention will be apparent in the detailed description with appropriate reference to the accompanying drawings.

DETAILED DESCRIPTION OF PREFERRED EMBODIMENT

Figure 1:
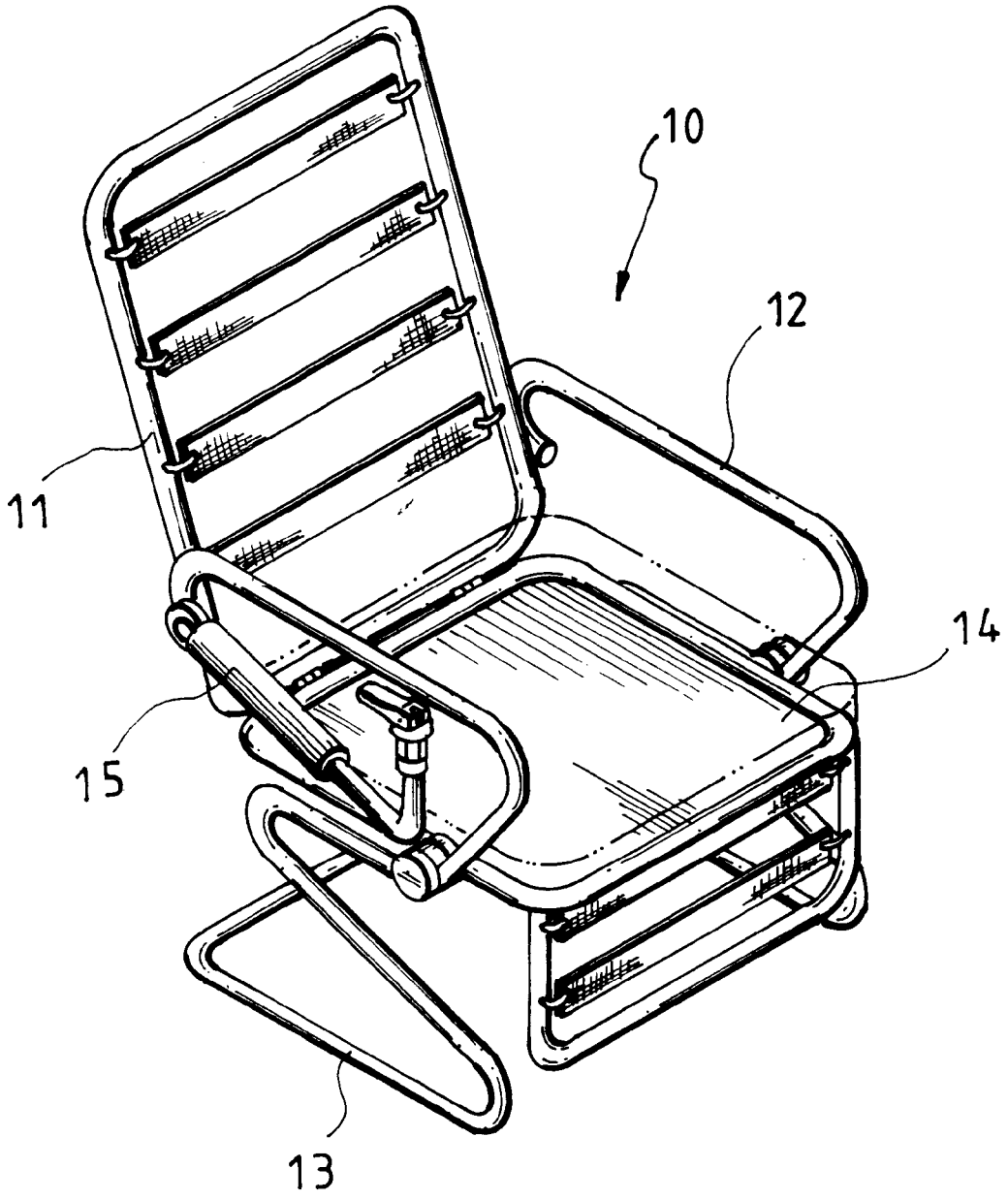
FIG. 1 is a perspective view of the present invention.

As showing in FIG. 1, an armchair (10) constructed in accordance with the present invention is shown. The armchair (10) having a seatback (11), a pair of armrests (12) securely mounted on both sides of the seatback (11), a spring-like base (13) securely and respectively engaged with the pair of armrests (12) and a seat (14) a side of which engages with a bottom side of the seatback (11) and provided between the armrests (12). The shape of the spring-like base (13) is substantially like a "Z", such that the base (13) is able to bear a suitable load thereon and provides comfort to the user seated thereon.

Figure 2:
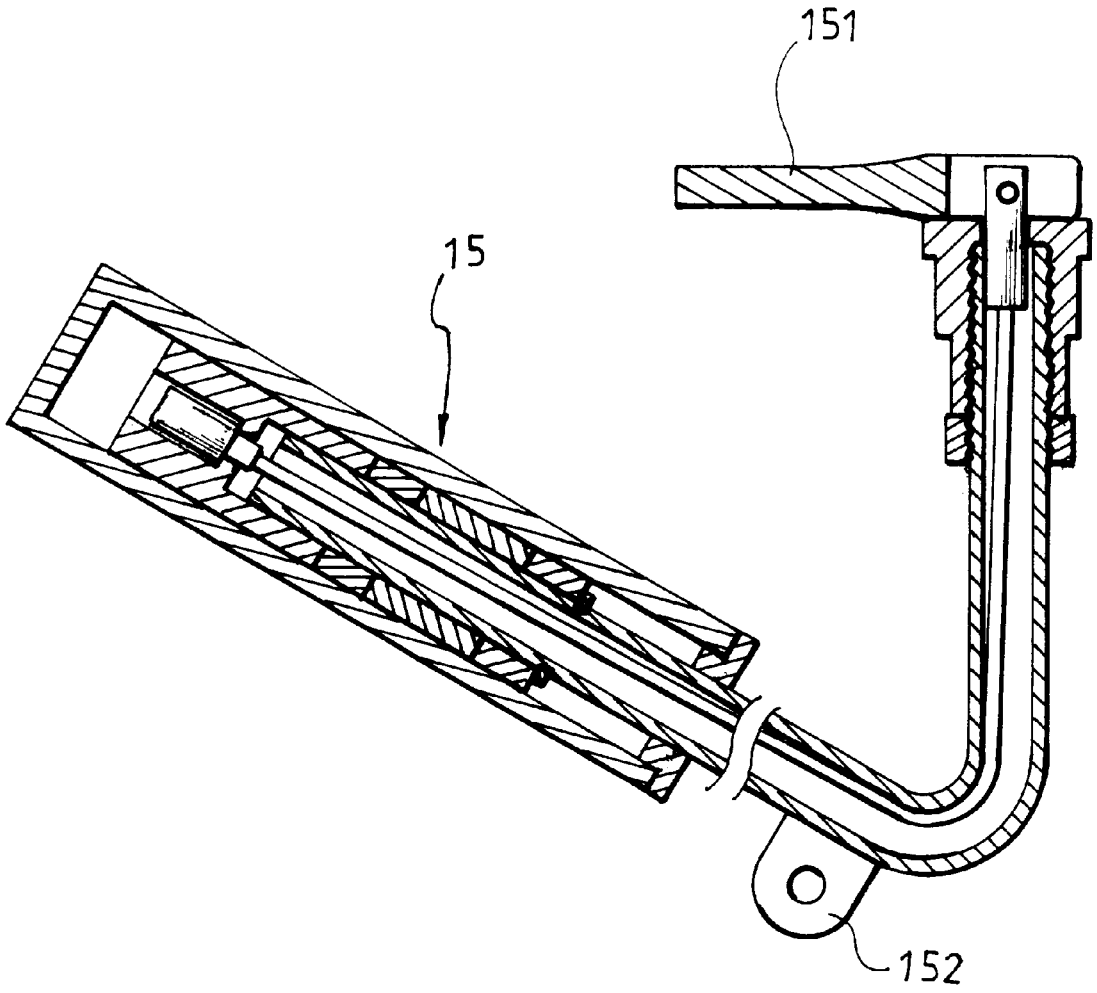
FIG. 2 is a cross sectional view showing the inner structure of a cylinder mounted between the armrest and the seatback.

Furthermore, the armchair (10) has a pneumatic cylinder (15) mounted between the seat (14) and the joint of the seatback (11) and one of the armrests (12) to provide a suitable resistance to the seatback (11) when the user is against the seatback (11). The pneumatic cylinder (15), as shown in FIG. 2, has a control handle (151) movably mounted on a top thereof so as to control the resistance output of the pneumatic cylinder (15). Because the inner structure of the pneumatic cylinder (15) is well known in the art, detailed description thereof is omitted. However, because the pneumatic cylinder (15) is mounted between the seat (14) and the joint of the seatback (11) and one of the armrests (12), adjustment to the pneumatic cylinder (15) by the control handle (151) will affect the relative difficulty of inclination of the seatback (11) to the seat (14). That is, then the pneumatic cylinder (15) is adjusted to have more resistance, the inclination of the seatback (11) will become harder. On the contrary, when the pneumatic cylinder (15) is adjusted to have less resistance, the inclination of the seatback (11) with respect to the seat (14) will become easier.

Figure 3:
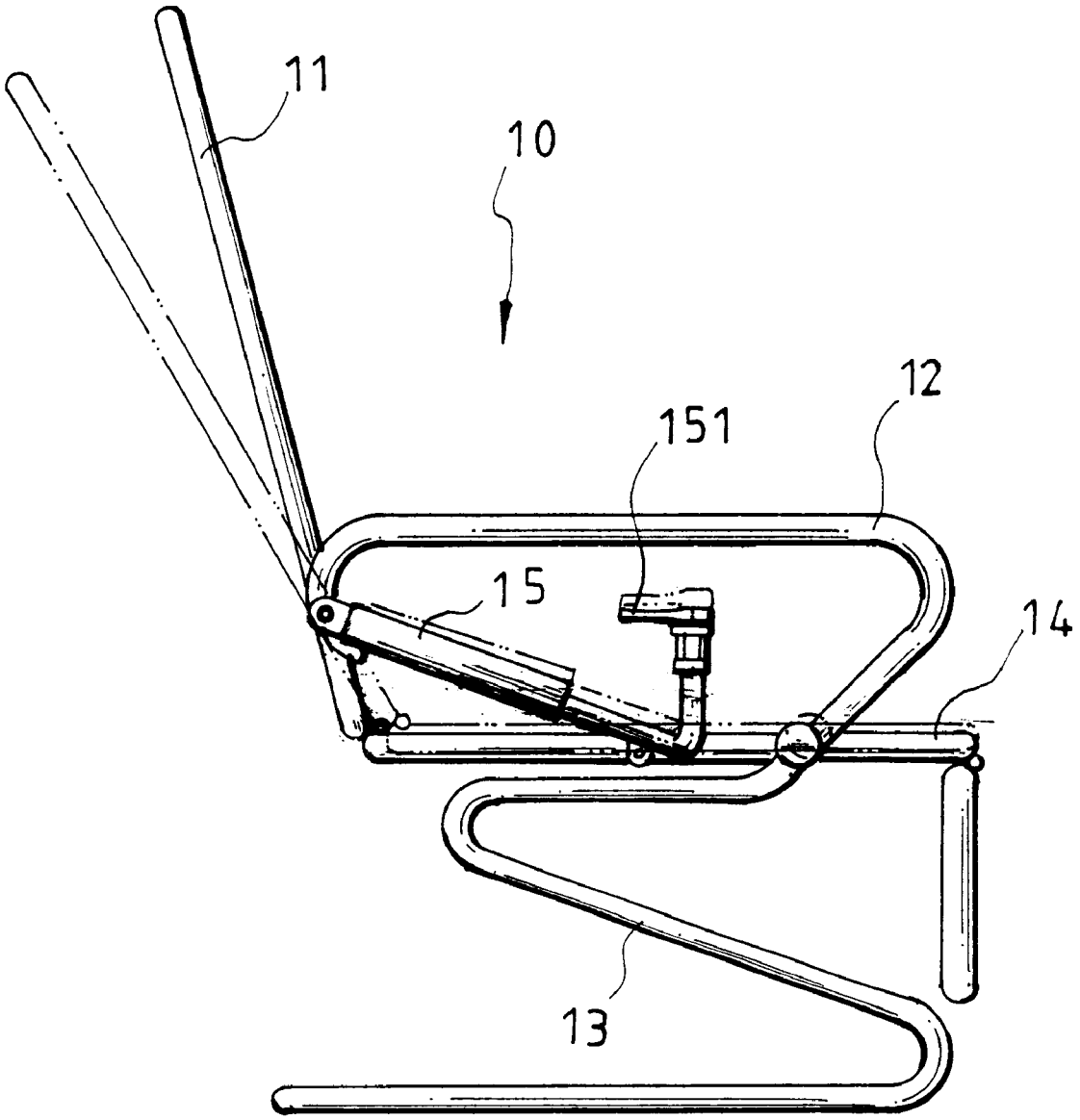
FIG. 3 is a side view of a armchair shown in FIG. 1, wherein the inclination of the seatback is adjustable via the cylinder.

Referring to FIG. 3, it is to be noted that when the pneumatic cylinder (15) is adjusted by the control handle (151) to have different resistance, the relative difficulty of the inclination of the seatback (11) with respect to the seat (14) is changed, so as that the armchair (10) of the invention is able to provide comfort to different users of different weights.

It is understood that although the invention is described in detail by means of preferred embodiment, alternation, changes, and modifications to the structure without departing from the spirit of the invention is able to be accomplished easily by persons skilled in the art. Therefore, the invention shall be defined by the following appended claims not by the content of the description.

What is claimed is:

1. An armchair comprising:

a seatback, a pair of armrests securely mounted on both sides of the seatback;

a spring-like base securely engaged with the pair of armrests, the spring-like base comprising Z-shaped members which absorb pressure when a load is applied to the armchair;

a seat connected to a bottom side of the seatback; and a pneumatic cylinder provided between the seat and a joint of the seatback and one of the armrests and having a control handle for adjusting the resistance output whereby the difficulty of inclination of the seatback with respect to the seat is accordingly adjusted.

* * * * *